United States Patent [19]

Miller

[11] 4,281,673

[45] Aug. 4, 1981

[54] HAIR CURLER

[76] Inventor: Alvin W. Miller, 323 S. McPherrin, Monterey Park, Calif. 91754

[21] Appl. No.: 972,288

[22] Filed: Dec. 22, 1978

Related U.S. Application Data

[63] Continuation of Ser. No. 766,840, Dec. 2, 1976, abandoned.

[51] Int. Cl.[3] ..... A45D 2/02

[52] U.S. Cl. ..... 132/39; 132/40

[58] Field of Search ..... 132/39, 40, 9

[56] References Cited

U.S. PATENT DOCUMENTS

| | | | |
|---|---|---|---|
| 2,429,176 | 10/1947 | Watson | 132/40 |
| 2,492,642 | 12/1949 | Interrante | 132/39 X |
| 2,775,244 | 12/1956 | Potitta | 132/33 R |
| 3,103,223 | 9/1963 | Trabish | 132/40 UX |

*Primary Examiner*—G. E. McNeill

*Attorney, Agent, or Firm*—Lyon & Lyon

[57] ABSTRACT

Disclosed herein is an apparatus for curling hair which is comprised of an elongated body member having at least one flute therein and an extended clip element slidably mounted on the body member such that a tress of hair can be readily disposed therebetween, rolled into a tight curl, secured with a bobby pin, a portion of which is positioned within the flute, and readily removed.

7 Claims, 13 Drawing Figures

FIG. 10
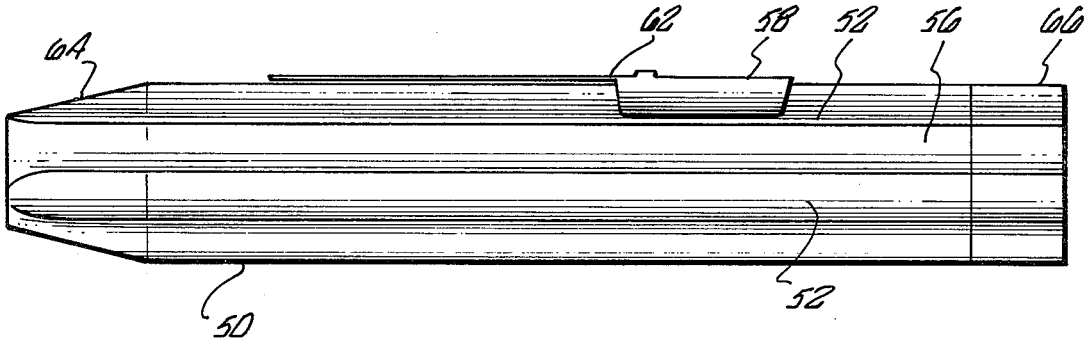
FIG. 11
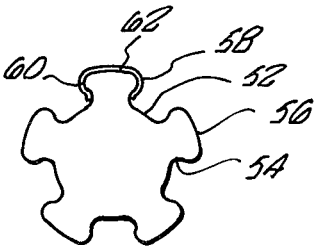
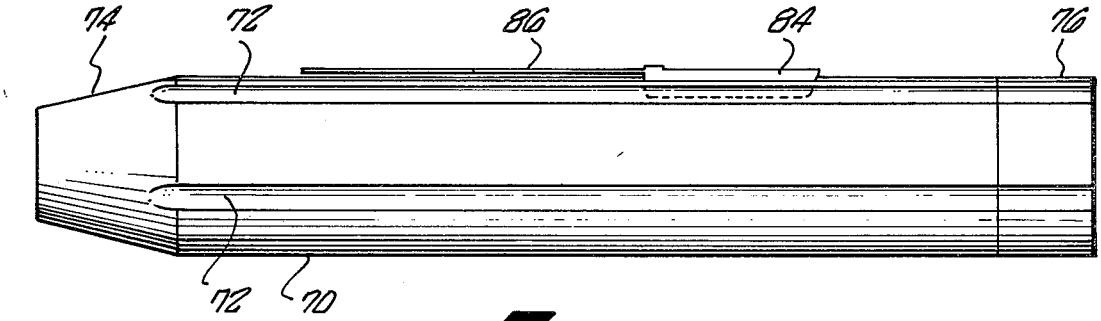
FIG. 12
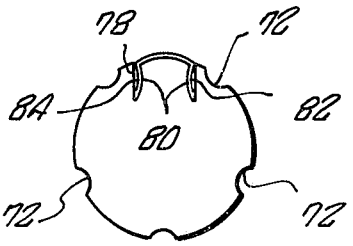
FIG. 13

HAIR CURLER

This application is a continuation of Ser. No. 746,840, 12/02/76 now abandoned.

The present invention relates to an apparatus for use in curling hair or producing curls. Typically, this process is carried out through the use of conventional curlers about which a tress of hair is wrapped and secured to the curler with a bobby pin. In an effort to avoid having to use a somewhat cumbersome curler, people have attempted to wrap the tresses about the handle of a hair brush or other substantially cylindrical instrument, secure the shape of the curl with a bobby pin and slide the formed and secured curl from the brush handle. This method of curling hair has not proved overly successful in view of the difficulty of securing the bobby pin and removing the secured curl from the brush handle without distorting the curl.

Among the objects of the present invention is to provide a device for facilitating the curling of hair or producing curls which obviates the use of separate curlers for each curl of hair. An illustrative embodiment of the present invention comprises a hollow tubular member which can house a plurality of bobby pins therein, has a plurality of flutes in the external surface thereof and a sliding element which may be applied to a tress of hair with the tress between the sliding element and the fluted member so that the two may be turned to roll the hair onto the fluted member to produce a curl. A bobby pin is then inserted along one of the flutes of the tubular member to hold the curl in a curled condition. The sliding element may then be slid from the curl and the member withdrawn leaving the formed curl held by the bobby pin. The curl may be left in that condition or, if desired, after setting, the curl may be combed out. The elimination of the conventional curler not only is esthetically pleasing but is considered more comfortable and promotes drying of the hair.

Other objects and advantages of the present invention will become apparent from the following detailed description taken in conjunction with the accompanying drawings.

IN THE DRAWINGS

FIG. 10 is a side view of a second embodiment of the curler.

FIG. 11 is an end view of the second embodiment of the curler.

FIG. 12 is a side view of a third embodiment of the curler.

FIG. 13 is an end view of the third embodiment of the curler.

Figure 1:
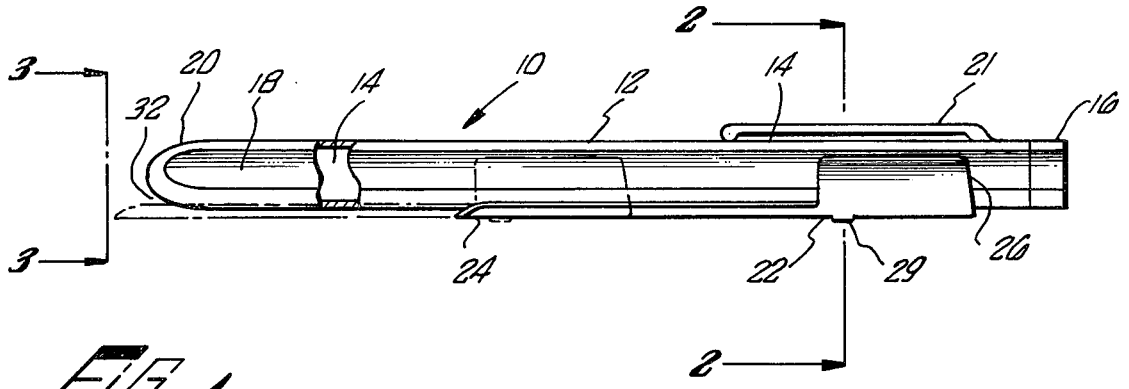
FIG. 1 is a side view of the hair curler of the present invention.
Figure 2:
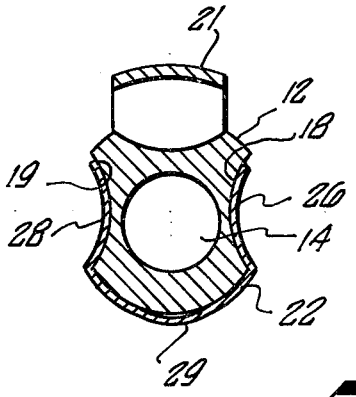
FIG. 2 is an enlarged sectional view taken along line 2—2 of FIG. 1 of the drawings.

Referring now in detail to the drawings, the hair curler 10 is comprised of a substantially cylindrical body member 12 defining arcuate hair support surface 13 and preferably including interior chamber 14 therein for the carrying of bobby pins and the like. A cap 16 is provided at the base end of the body member for sealing the chamber. The exterior portion of the body member is provided with a plurality of flutes 18 and 19 extending parallel to the longitudinal axis of the body member. The forward end portion 20 of the body member is tapered to facilitate cooperation with the hair as will be discussed. If desired, a pocket clip 21 can be integrally formed or otherwise secured to the rearward portion of the body member 12.

A clip member 22 having a tapered end portion 24 defining an arcuate hair gripping surface 25 on the inner side thereof and an arcuate hair rolling surface 27 on the outer side thereof. The clip 22 is slidably mounted on the body portion by means of a pair of flange portions 26 and 28 which are so shaped as to ride within a pair of flutes, pressing against the surfaces thereof. The clip member may, if desired, be provided with a protruding gripping surface 29 which may be engaged by the finger or fingernail of the user when sliding the clip along the body member.

In FIG. 1, the clip member 22 is shown in solid lines in the retracted position with the rear end portion adjacent cap 16. The dotted lines illustrate the clip member in the forward or projected position to provide an entry throat 32 between the forward end 20 of body member 12 and the tapered end portion 24 of the clip 22 for receiving a tress of hair 30.

Figure 4:
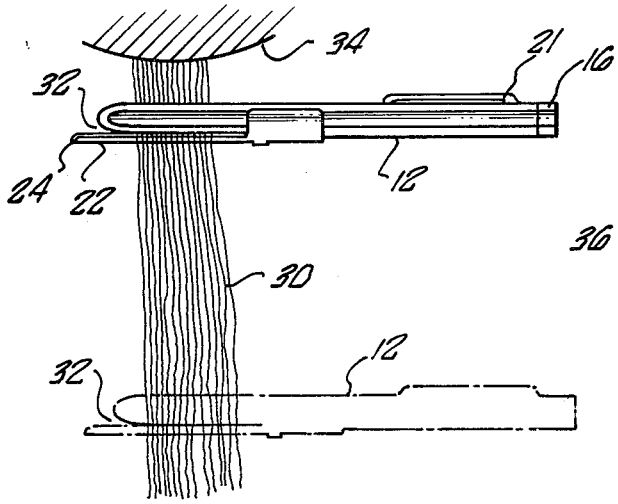
FIG. 4 is a diagrammatic view of the curler showing its application to a tress of hair.
Figure 5:
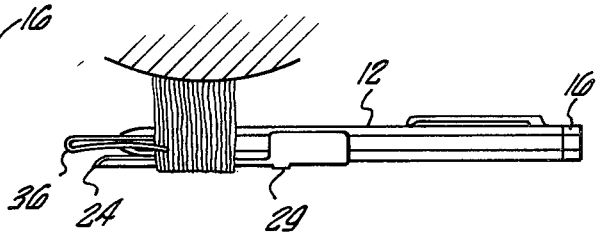
FIG. 5 is a diagrammatic view of the curler showing the application thereof after forming the curl in the initial step of inserting a bobby pin.
Figure 6:
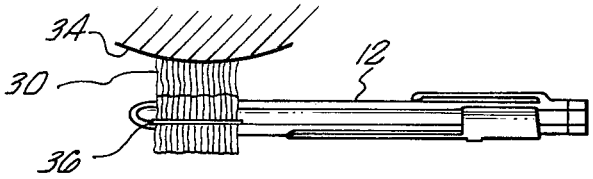
FIG. 6 is a diagrammatic view of the curler showing the withdrawl of the body member from the curl.
Figure 7:
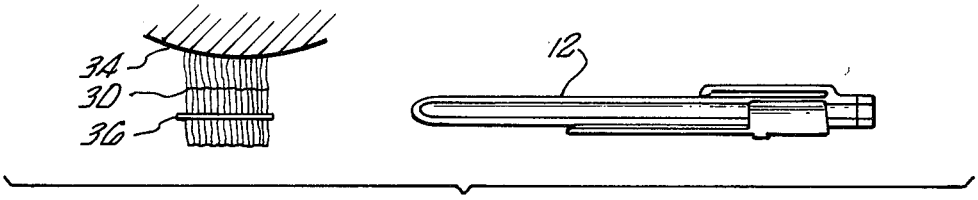
FIG. 7 is a diagrammatic view of the curler and secured curl after complete withdrawl of the curler from the curl.
Figure 8:
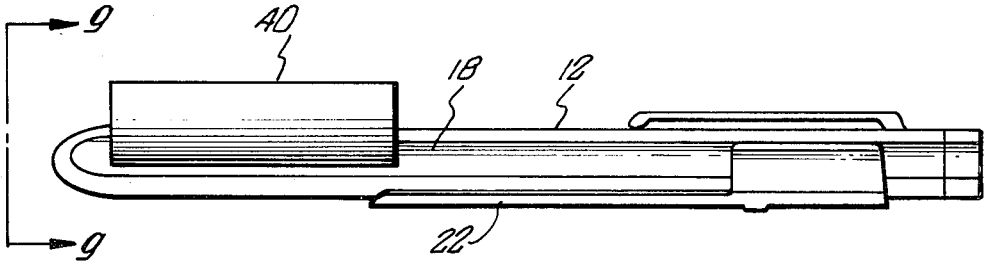
FIG. 8 is a side view of the curler illustrating the use of an enlarged insert therewith.
Figure 9:
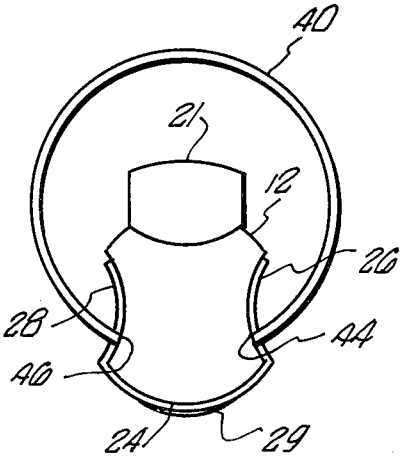
FIG. 9 is an end view of the enlarged curling insert.

In use, a tress of hair 30 is stretched from the head 34, as shown in FIG. 4, and with the clip member 22 in the forward position such that the tapered end portion 24 thereof extends beyond the forward end 20 of the body member to form an entry throat 32, the curler is moved relative to the tress so as to cause the tress to enter the throat between the clip and the body members as shown in FIG. 5 in solid lines. The curler can then be moved from the solid line position shown in FIG. 4 to the phantom line position with the tress of hair held between the body member 12 and the interior arcuate surface 33 of the clip member. This movement strains or combs the hair so that it is evenly arranged for rolling into a curl and is accomplished by the proximate spacing between the interior surface 33 of the clip member and the body member without the need for any pressure being exerted on the clip member. The curler is then rotated so at to roll the tress into a curl about the body member and outer arcuate surface 35 of the clip to the position illustrated in FIG. 5. While holding the body member in this position, the user then inserts a bobby pin 36 by spreading its legs and inserting one of the legs into a flute 38 within the rolled curl and the other leg about the outside of the curl and sliding the pin into the position illustrated in FIG. 6. The user with his finger or fingernail then urges the clip member from the curl with the aid of protrusions 29 to the position as shown in FIG. 6. The entire instrument is then withdrawn from the curl as illustrated in FIG. 7. In this position it will be noted that the bobby pin is disposed between the curl and the head of the person so that it can be completely hidden and the curl may be worn with the bobby pin attached if desired.

Figure 3:
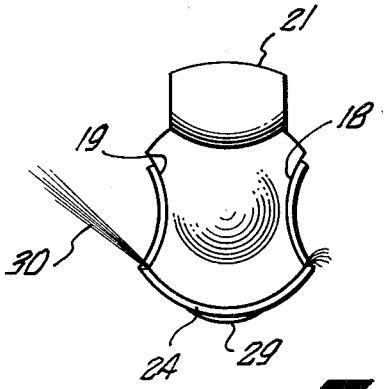
FIG. 3 is an end view of the hair curler illustrating the tress of hair held between the clip and body portion.

It should be noted that the clip member is arc-shaped in cross-section so that the arcuate hair gripping surface 25 and hair rolling surface 27 follow the same curvature as the outer surface of the body member so that as the tress of hair is slid in between the clip and body member, it will be disposed in a curve or arc which is a part of the form of the final curl when the tress is rolled by the instrument. The initial formation of the tress, as shown in FIG. 3, is then a part of the cylindrical form the curl eventually takes when completed.

In use, it has been found that the clip member 22 should be withdrawn from the curl prior to withdrawl of the body member so as to relieve the pinching effect on the curl. Because the tress of hair is clamped between the clip element and the body member, if they were withdrawn together, there would be a danger of distorting the curl. By first removing the clip element from the curl which effectively reduces the diameter of the instrument, the body member may then be easily withdrawn without pulling across and distorting the formation of the curl as often occurs with conventional curlers.

While the hair curler 10 above described produces curls of a constant diameter and different hair styles require differently sized curls, a plurality of differently sized split rollers 40 can be provided for use with the curler in forming differently sized curls. The roller 40 is cylindrical, having an open longitudinal section extending therealong bordered by surfaces 44 and 46. In using the split roller 40 the edges 44 and 46 are disposed in flutes 18 and 19 whereby the roller is secured to and disposed below the body member 12. The curler with the roller so attached is then used as above described to form a larger curl. In this manner, the roller effectively increases the diameter of the body portion of the curler.

With the aforedescribed invention, any number of curls may be made or formed with a single instrument, each curl having only a hidden bobby pin to hold the curl in its desired form.

A second embodiment of the invention for forming larger curls is illustrated in FIGS. 10 and 11. As seen therein, the body member 50 is of a larger diameter than the body member 12 of the prior embodiment and defines a plurality of flutes 52 disposed between a corresponding plurality of protrusions 54 having enlarged head portions 56. The flange portions 58 and 50 of clip 62 extend about one of the enlarged head portions and grip the sides of the protrusion thereby slidably securing the clip 62 to the body member 50. The body member also has a tapered forward end 64 and an end cap 66 sealing an interior chamber. This embodiment of the invention is utilized in the same manner as the prior embodiment and provides increased flexibility in the positioning of the bobby pin due to the increased number of flutes 52.

A third embodiment of the invention is illustrated in FIGS. 12 and 13. As illustrated therein, the body member 70 is provided with a plurality of uniformly spaced flutes 72, a tapered forward end 74, a sealing cap 76 and a pair of slots 78. The slots 78 define curved inner surfaces 80 and receive the flange portion 82 and 84 of clip 86 which bear against the curved surfaces and slidably secure the clip to the body member. The third embodiment of the invention is utilized in the same manner as the previous embodiment to curl the hair.

Various changes and modifications may be made in carrying out the present invention without departing from the spirit and scope thereof. Insofar as these changes and modifications are within the purview of the appended claims, they are to be considered as part of the invention.

I claim:

1. A hair curler for use with a bobby pin in forming a tress of hair into a curl, said curler comprising an elongated body member defining a convex arcuate support surface, and a clip member having a forwardly extending arcuate end portion defining an inner concave gripping surface and an outer convex roller surface and being slidably mounted over and along said arcuate support surface of said body member, the end of said body member and said extending end portion of said clip cooperating to receive the entry of a portion of a tress of hair therebetween and between said convex arcuate surface of said body member and said inner gripping surface of said clip such that said tress can be held therebetween and said curler can be moved along said tress to bring said tress to even alignment for rolling into a uniform curl, said body member further defining at least one longitudinally extending flute in the exterior surface thereof adapted to receive the leg of a bobby pin such that upon rolling said tress about said outer rolling surface of said clip, said pin can be disposed about said tress with one leg thereof disposed within said flute and said clip can be slidably moved along said body member rearwardly of said tress releasing said tress from said curler and leaving said tress in a curled disposition secured by said bobby pin.

2. A hair curler for use with a bobby pin in forming a tress of hair into a curl, said curler comprising an elongated body member defining a convex arcuate support surface and having a tapered end portion, guide means extending along the interior surface of said body member adjacent said support surface, and a clip member having a forwardly extending arcuate end portion defining an inner concave gripping surface and outer convex roller surface and being slidably mounted along said guide means for longitudinal movement over said arcuate support surface, said tapered end portion of said body member and said extending end portion of said clip cooperating to receive the entry of a portion of a tress of hair therebetween and between said support surface and the concave roller surface defined by the forwardly extending arcuate end portion of said clip such that said tress can be held therebetween and said curler can be moved along said tress to bring said tress to even alignment for rolling into a uniform curl, said body member further defining at least one longitudinally extending flute in the exterior surface thereof adapted to receive the leg of a bobby pin such that upon rolling said tress about said outer rolling surface of said clip, said pin can be disposed about said tress with one leg thereof disposed within said flute and said clip can be slidably moved along said body member rearwardly of said tress releasing said tress from said curler and leaving said tress in a curled disposition secured by said bobby pin.

3. A hair curler for use with a bobby pin in forming a tress of hair into a curl, said curler comprising: an elongated body member defining an interior storage chamber therein, a plurality of longitudinal flutes in the surface thereof and a pair of longitudinally extending clip receiving slots; and a clip member having a forwardly extending arcuate end portion and a pair of flange portions, said end portion defining a concave gripping surface and concave rolling surface, said flange portions extending into said receiving slots and bearing against a portion of said body member defining said slots for securing said clip member to said body member and allowing longitudinal sliding of said clip along said body member, said tapered end portion of said body member and said extending end portion of said clip cooperating to receive entry of a portion of a tress of hair therebetween and between said body member and said concave gripping surface defined by the arcuate end portion of said clip such that said tress can be held therebetween and said curler moved along said tress to bring said tress to even alignment for rolling into a uniform curl, said body member further defining at least one longitudinally extending flute in the exterior surface thereof adapted to receive the leg of a bobby pin such that upon rolling said tress about said outer rolling surface of said clip, said pin can be disposed about said tress with one leg thereof disposed within said flute and said clip can be slidably moved along said body member rearwardly of said tress releasing said tress from said curler and leaving said tress in a curled disposition secured by said bobby pin.

4. A hair curler for use with a bobby pin forming a tress of hair into a curl, said curler comprising: an elongated body member defining an interior storage chamber therein, a plurality of raised rib portions spaced about the surface of said body member defining a plurality of concave support surfaces and a plurality of longitudinally extending flutes disposed between said rib portions; and a clip member having a forwardly extending arcuate end portion and a pair of flange portions, said end portion defining a concave gripping surface and a convex roller surface, said flange portions bearing against the opposite sides of one of said raised rib portions for affixing said clip portion to said body member and allowing said clip portion to be longitudinally slided along said body member, one end of said body member and said extending end portion of said clip cooperating to receive the entry of a portion of a tress of hair therebetween and between said body member and said concave gripping surface defined by said arcuate end portion of said clip such that said tress can be held therebetween and said curler moved along said tress to bring said tress to even alignment for rolling into a uniform curl, said body member further defining at least one longitudinally extending flute in the exterior surface thereof adapted to receive the leg of a bobby pin such that upon rolling said tress about said outer rolling surface of said clip, said pin can be disposed about said tress with one leg thereof disposed within said flute and said clip can be slidably moved along said body member rearwardly of said tress releasing said tress from said curler and leaving said tress in a curled disposition secured by said bobby pin.

5. A hair curler for use with a bobby pin in forming a tress of hair into a curl, said curler comprising: an elongated body member defining a convex arcuate support surface and a clip member having a forwardly extending arcuate end portion defining an inner concave hair gripping surface and an outer convex hair roller surface and being slidably mounted over and along said arcuate support surface of said body member, the end of said body member and said extending end portion of said clip cooperating to receive the entry of a portion of a tress of hair therebetween said convex arcuate surface of said body member and said concave gripping surface of said clip, said body member further defining at least one longitudinally extending flute in the exterior surface thereof adapted to receive the leg of a bobby pin such that upon rolling said tress into a curl about said outer rolling surface of said clip, said pin can be disposed about said tress with one leg thereof disposed within said flute whereupon said clip can be slidably moved along said body member rearwardly of said curl reducing the cross-sectional area of said curler within said curl thereby releasing said curl from said curler without deforming said curl and leaving said curl secured by said bobby pin.

6. The combination of claim 1 wherein said flute defines means for guiding said clip over and along said arcuate support surface.

7. The combination of claim 1 wherein said body member defines a pair of said longitudinally extending flutes disposed on opposite sides of the exterior surface of said body member and including a cylindrical curling roller having a cross-sectional diameter greater than the cross-sectional diameter of said body member and having a longitudinal gap extending therealong to define a pair of tripping surfaces, said gripping surfaces being adapted to be disposed within said flutes for securing said roller to said body member.

* * * * *